US007157861B2

(12) United States Patent
Chou et al.

(10) Patent No.: US 7,157,861 B2
(45) Date of Patent: Jan. 2, 2007

(54) PUSH-PULL INVERTER CIRCUIT

(75) Inventors: Chin-Wen Chou, Taipei Hsien (TW); Ying-Nan Cheng, Taipei Hsien (TW); Chin-Biau Chung, Taipei Hsien (TW)

(73) Assignee: Zippy Technology Corp., Taipei Hsien (TW)

( * ) Notice: Subject to any disclaimer, the term of this patent is extended or adjusted under 35 U.S.C. 154(b) by 0 days.

(21) Appl. No.: 10/945,999

(22) Filed: Sep. 22, 2004

(65) Prior Publication Data

US 2006/0061298 A1 Mar. 23, 2006

(51) Int. Cl.
*H05B 37/02* (2006.01)

(52) U.S. Cl. ..... 315/209 PZ; 315/274; 315/276; 315/307

(58) Field of Classification Search ..... 315/209 PZ, 315/291, 307, 274, 276, 282, 284; 323/337; 363/153

See application file for complete search history.

(56) References Cited

U.S. PATENT DOCUMENTS 6,025,824 A * 2/2000 Horiuchi et al. ..... 345/102
6,153,962 A * 11/2000 Noma et al. ..... 310/316.01
6,226,196 B1 * 5/2001 Toshinari et al. ..... 363/134
6,758,199 B1 * 7/2004 Masters et al. ..... 123/620
6,911,787 B1 * 6/2005 Takeda et al. ..... 315/209 PZ

FOREIGN PATENT DOCUMENTS

TW 557073 10/2003

* cited by examiner

*Primary Examiner*—Tuyet Thi Vo
(74) *Attorney, Agent, or Firm*—Birch, Stewart, Kolasch & Birch, LLP

(57) ABSTRACT

The present invention discloses a push-pull inverter circuit comprising a transformer with a power output end coupled to a load and two power input ends, and a power driver unit is connected between the two power output ends and a power supply unit, and the power driver unit receives a power signal and outputs two sets of drive signals having same frequency and opposite phase to the two power input ends as to constitute an inverter circuit that adopts a push-pull voltage drive signal to drive the transformer to operate and improve the output power of the transformer.

5 Claims, 4 Drawing Sheets

PUSH-PULL INVERTER CIRCUIT

FIELD OF THE INVENTION

The present invention relates to a push-pull inverter circuit, more particularly to an inverter circuit that adopts a push-pull voltage drive signal to drive a transformer to operate and improve the output power of the transformer.

BACKGROUND OF THE INVENTION

In general, the LCD used for desktop and notebook computers, personal digital assistants (PDAs) and webpads adopts a driver unit to output high voltage and a piezoelectric ceramic transformer to light up a cold cathode fluorescent lamp (CCFL). The prior-art driver unit is described as follows:

The common driver for driving to light up the CCFL as shown in FIG. 1 comprises: a power supply unit, a pulse width modulation (PWM) controller, a driver unit (MOSFET), a piezoelectric ceramic transformer and a loaded cold cathode fluorescent lamp. If the input voltage is turned on, the driver unit will immediately drive the piezoelectric ceramic transformer to operate and the cold cathode fluorescent lamp to be lit by a negative/positive transformation effect, and a pulse width modulation (PWM) controller outputs a resonant frequency by a tube current of the electric current feedback detecting lamp, and the average current of the CCFL tube can be controlled by the driver unit and the transformer. Therefore, the light produced can be projected on the screen of a backlit display.

The magnitude of the output power of the piezoelectric ceramic transformer determines the lit-up length according to the magnitude of the outputted voltage, the equivalence of being loaded in the same cold cathode fluorescent lamp and the output power. Since the display (particularly the LCD TV) tends to be specified and designed in a large size, the CCFL must adopt a long fluorescent tube if the short fluorescent tubes are not arranged alternatively. However, a long fluorescent tube requires more current and higher power. The inventor of the present invention disclosed a "Multiple sets of load driver circuits being applied for piezoelectric transform circuit of long fluorescent tube" in the R.O.C. Patent Publication No. 557,073, which uses two piezoelectric ceramic transformers being connected in parallel and having opposite polarities of the power input ends to receive a voltage drive signal of the driver unit with same phase and output the voltage of an opposite phase to the CCFL by a push-pull method, so that the output current can be even and features a larger power output and better impedance.

Although such patent can solve the power issue of the long fluorescent lamp, the quantity of lamps has to be taken into consideration besides the length, since the quantity of lamps increases as the size increases. In that patent, each lamp must have a set of piezoelectric ceramic transformers, not only increasing the cost, but also creating a problem of increasing the operating temperature and the size of the circuit board to manufacturers.

SUMMARY OF THE INVENTION

The primary objective of the present invention is to overcome the foregoing shortcoming and avoid the exiting deficiency. The inventor of the present invention conducted extensive researches and experiments, and finally invented the inverter circuit that also adopts a push-pull voltage drive signal, but uses a power driver unit connected between two power input ends of the transformer unit of the inverter circuit and the power supply unit to output two sets of drive signals having same frequency and different phase to the two power input ends as to constitute an inverter circuit that uses a push-pull voltage drive signal to drive the transformer unit to operate and improves the output power of the transformer unit in order to save the installation of another transformer unit and thus can lower the manufacturing cost and further reduce the overall size of the circuit board.

DETAILED DESCRIPTION OF THE PREFERRED EMBODIMENTS

To make it easier for our examiner to understand the objective of the invention, its structure, innovative features, and performance, we use a preferred embodiment and the attached drawings for the detailed description of the invention.

Figure 1:
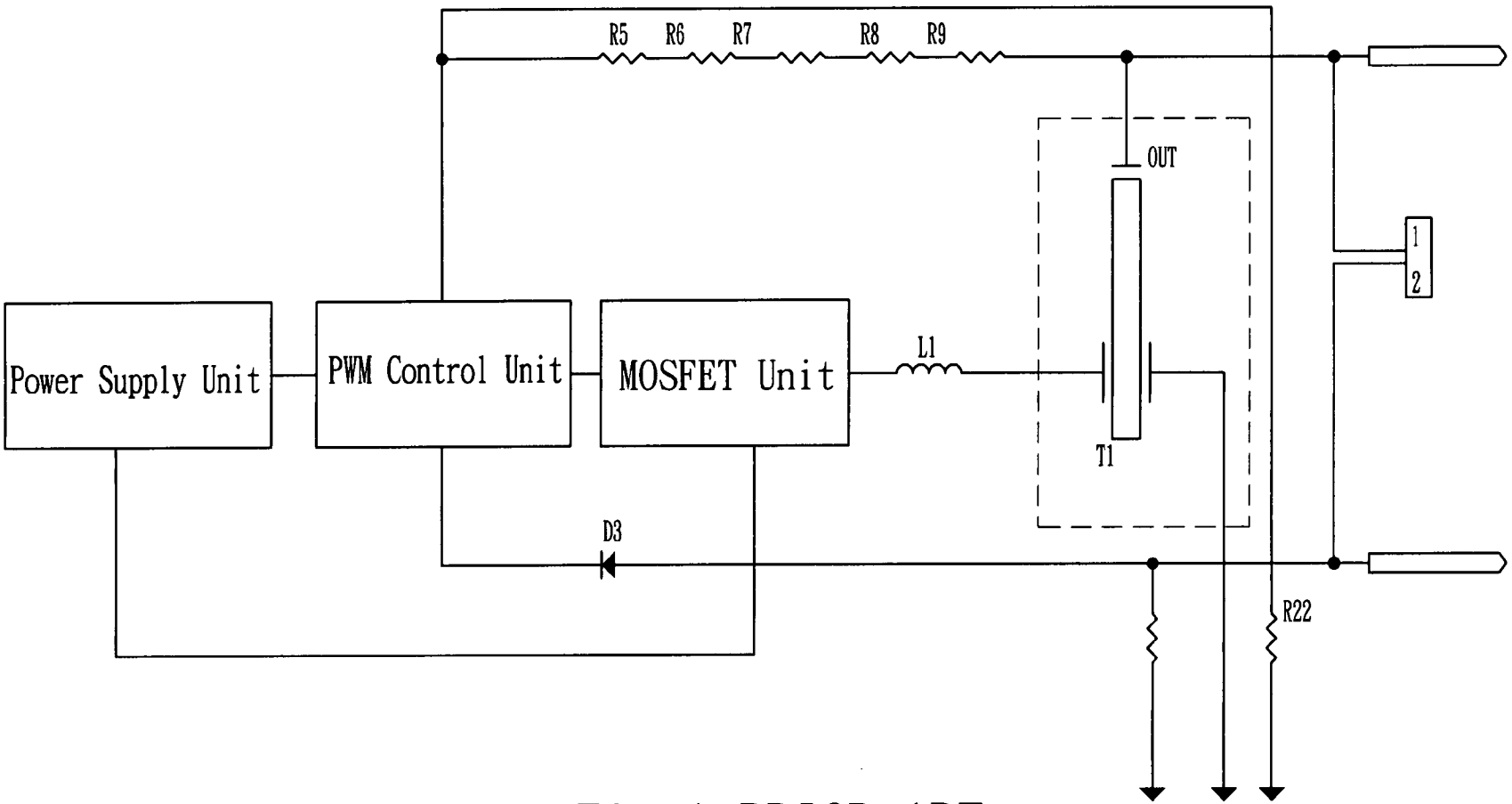
Fig. 1 PRIOR ART
FIG. 1 is a circuit block diagram of a prior-art transformer inverter.
Figure 2:
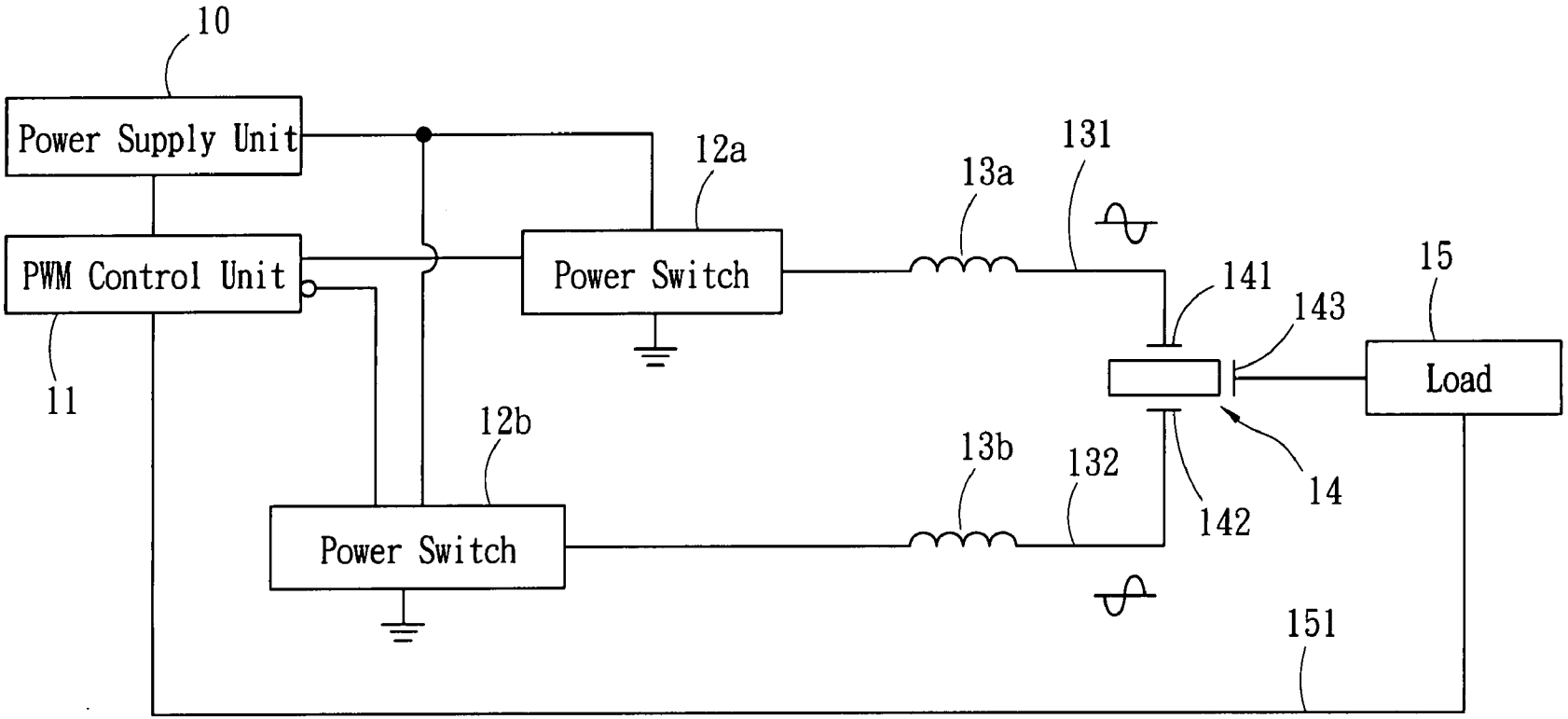
FIG. 2 is a circuit block diagram of the driver circuit according to a first preferred embodiment of the present invention.

Please refer to FIG. 2 for the circuit block diagram of a drive circuit according to a first preferred embodiment of the present invention. In FIG. 2, the present invention receives a power signal inputted by a power supply unit 10 and drives a load 15 to operate after said power signal goes through a resonant transformation. The power unit 10 refers to a direct current produced by rectifying an alternate current, and the inputted power signal could be a direct current signal corrected by a power factor regulator (the existing technology usually adopts 12V~48V) or a direct rectified pulse direct current signal (the existing technology usually adopts 155V). The inverter circuit is installed between the power supply unit 10 and the load 15; wherein the inverter circuit comprises a transformer unit 14, and the transformer unit 14 has a power output end 143 connected to a load 15 and two power input ends 141, 142 and a power drive unit is connected between the power output ends 143 and the power supply unit 10, and the power driver unit receives the power signal and sends two sets of drive signals 131, 132 having same frequency and opposite phase outputted by the transformer unit 14 to the two power input ends 141, 142 as to constitute an inverter circuit that uses a push-pull voltage drive signal 131, 132 to drive the transformer unit 14 to operate.

The power driver unit according to a first preferred embodiment of the present invention comprises a control unit 11 and two sets of power switches 12*a*, 12*b*, and the foregoing transformer unit 14 could be a coiled transformer or a piezoelectric transformer. If the piezoelectric transformer is adopted, then an inductor 13*a*, 13*b* is disposed between the power switches 12*a*, 12*b*. For simplicity, the piezoelectric transformer is used for the illustration of this invention. The control unit 11 is a pulse width modulator (PWM) and the power switches 12*a*, 12*b* are power transistors (MOSFET). When the power supply unit 10 inputs a power signal, the power switches 12*a*, 12*b* are turned on immediately. When the control unit 11 receives a feedback resonant frequency signal 151 of a load 15 to output two sets of drive signals 131, 132 having same frequency and opposite phase to the power switches 12*a*, 12*b*. Then, the power switches 12*a*, 12*b* divide the power signals by the output frequency of the control unit 11 to the inductor 13*a*, 13*b*, and the inductor 13*a*, 13*b* will correct the connected square waveform of the power switches 12*a*, 12*b* to a sine waveform. In the figure, it is obvious that the drive signals 131, 132 are opposite and thus if the drive signal 131 of the positive power input end of the transformer unit 14 is a positive half-cycle power signal, the drive signal 132 of the negative power input end 142 of the transformer unit 14 is a positive half-cycle power signal, and vice versa. Since one of the drive signals 131 is a positive phase sine wave signal and the other drive signal 132 is an inverted sine wave, therefore the transformer unit 14 produces a push-pull voltage drive such that the transformer unit 14 produces the maximum power output to drive the load 15 from the power output end 143 under both input voltage drives.

Figure 3:
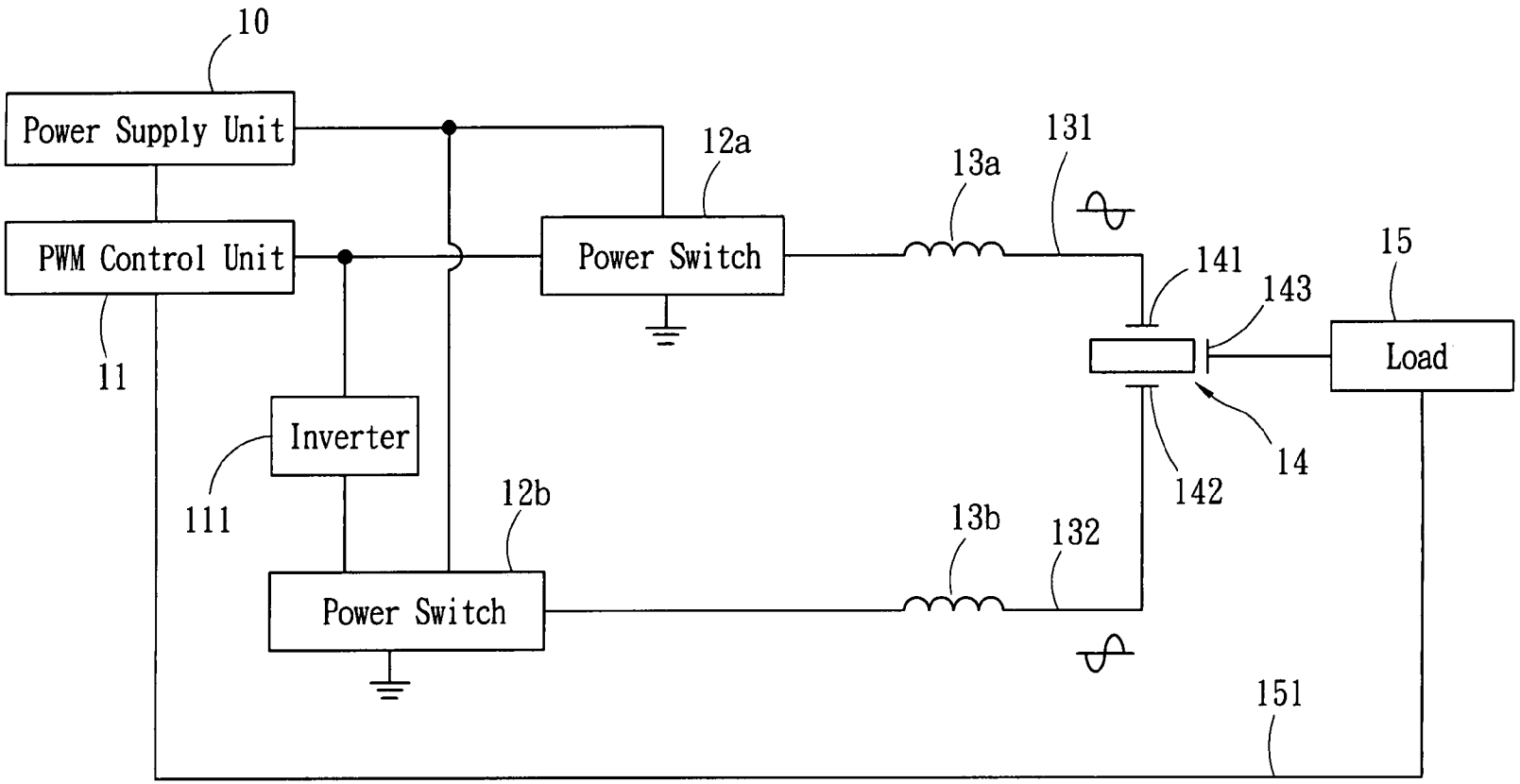
FIG. 3 is a circuit block diagram of the driver circuit according to a second preferred embodiment of the present invention.

Please refer to FIG. 3 for the circuit block diagram of the drive circuit according to a second preferred embodiment of the present invention. In FIG. 3, various control units 11 have different designs. If the control unit 11 outputs two sets of drive signals having same frequency and same phase, then a waveform inverter 111 is installed between one of the power switches 12*b* and the control unit 11. If the control unit 11 outputs a drive signal having the same positive phase, then the waveform inverter 111 is used to convert the positive drive signal into an inverted drive signal and reverse the phase of the inputted drive signal 131, 132, and thus achieving the same function of the first preferred embodiment.

Figure 4:
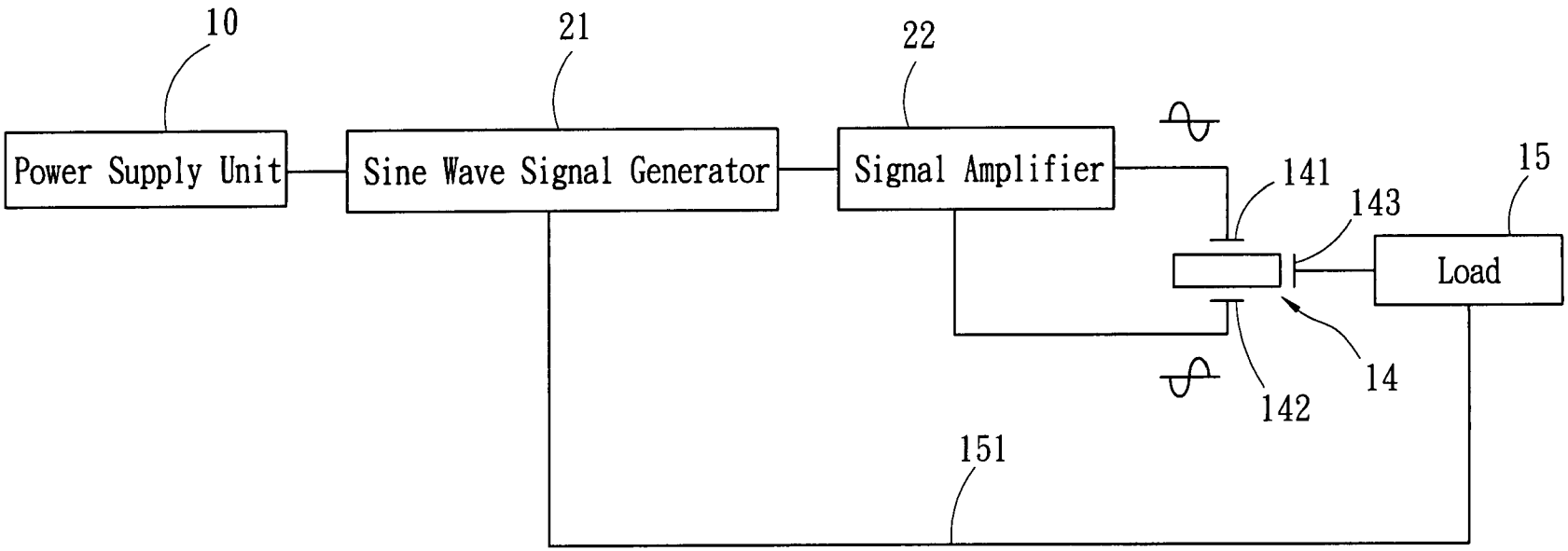
FIG. 4 is a circuit block diagram of the driver circuit according to a third preferred embodiment of the present invention.

Please refer to FIG. 4 for the circuit block diagram of the drive circuit according to a third preferred embodiment of the present invention. Besides the forgoing embodiment, the power driver unit as shown in FIG. 4 could comprise a sine wave generator 21 and a signal amplifier 22. The sine wave generator 21 directly corresponds to the feedback resonant frequency signal 151 of the load 15 to output a sine wave frequency signal. The signal amplifier unit 22 receives the sine wave frequency signal and inputs the gained and amplified signal into the transformer unit 14. Since the phase is opposite, then the signal amplifier unit 22 could be comprised of a mixed AB type power amplifier, and the driving method is the same as that described above.

While the invention has been described by way of example and in terms of a preferred embodiment, it is to be understood that the invention is not limited thereto. To the contrary, it is intended to cover various modifications and similar arrangements and procedures, and the scope of the appended claims therefore should be accorded the broadest interpretation so as to encompass all such modifications and similar arrangements and procedures.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

The present invention will become more fully understood from the detailed description given hereinbelow and the accompanying drawings which are given by way of illustration only, and thus are not limitative of the present invention, and wherein:

What is claimed is:

1. A push-pull inverter circuit, being disposed between a power supply unit and a load for receiving a power signal inputted by said power supply unit and driving said load by a power conversion of said inverter circuit and said inverter circuit comprising:

a transformer unit, having a power output end and a power input end, the power output end being connected to said load;

a power driver unit, being connected between said power output end and said power supply unit for receiving said power signal and outputting two sets of drive signals having same frequency and opposite phase to said power input end as to constitute said inverter circuit that uses a push-pull voltage drive signal to drive the operation of said transformer unit;

said power drive unit comprises a control unit and two sets of power switches, the control unit outputs two sets of drive signals having a same frequency and opposite phase, and an inductor being disposed between at least one of the power switches and said transformer unit.

2. The push-pull inverter circuit of claim 1, wherein said power signal inputted by said power supply unit is a direct current power signal.

3. The push-pull inverter circuit of claim 1, wherein said power signal inputted by said power supply unit is a pulse direct current power signal.

4. The push-pull inverter circuit of claim 1, wherein said control unit outputs two sets of drive signals having same frequency and opposite phase.

5. The push-pull inverter circuit of claim 1, wherein said control unit outputs two sets of drive signals having same frequency and opposite phase, and comprises a waveform inverter between one of said power switch and said control unit.

* * * * *